US010767928B1

(12) United States Patent
Visit

(10) Patent No.: US 10,767,928 B1
(45) Date of Patent: Sep. 8, 2020

(54) DRYING APPARATUS

(71) Applicant: Jill Visit, Austin, TX (US)

(72) Inventor: Jill Visit, Austin, TX (US)

( * ) Notice: Subject to any disclaimer, the term of this patent is extended or adjusted under 35 U.S.C. 154(b) by 43 days.

(21) Appl. No.: 16/285,857

(22) Filed: Feb. 26, 2019

Related U.S. Application Data

(60) Provisional application No. 62/635,055, filed on Feb. 26, 2018.

(51) Int. Cl.
*F26B 19/00* (2006.01)

(52) U.S. Cl.
CPC ..... *F26B 19/00* (2013.01)

(58) Field of Classification Search
CPC .... F26B 19/00; F26B 3/00; F26B 5/00; F26B 21/00
USPC ..... 34/312, 210–218
See application file for complete search history.

(56) References Cited

U.S. PATENT DOCUMENTS 2,163,324 A 6/1939 Reinhold
2,493,681 A * 1/1950 Mayer ..... A63B 47/04 134/6
2,573,214 A * 10/1951 Moran ..... D06F 57/00 34/523
2,812,098 A 11/1957 Escaut
3,281,883 A * 11/1966 Glantz ..... A63B 47/007 15/210.1
4,071,921 A * 2/1978 Jury ..... A41D 13/082 15/227
4,321,756 A 3/1982 Mosely
4,715,963 A 12/1987 Jones
5,337,891 A * 8/1994 Toth ..... G03B 17/08 206/316.2
5,380,093 A 1/1995 Goldman
5,708,982 A * 1/1998 Armani ..... A45D 8/40 2/171
5,720,736 A * 2/1998 Hatsuda ..... A61F 13/15 427/180
5,898,968 A * 5/1999 Beattie ..... A63B 47/04 15/210.1

(Continued)

FOREIGN PATENT DOCUMENTS

DE 2365769 A1 * 4/1976 ..... C12Q 1/04
DE 3929729 A1 * 3/1991 ..... B28C 5/1246

(Continued)

OTHER PUBLICATIONS

Bed Bath and Beyond webpage; Trudeau Salad Microfiber Salad Dryer Bag; 2017; 2 pages.

*Primary Examiner* — Stephen M Gravini
(74) *Attorney, Agent, or Firm* — Waller Lansden Dortch & Davis, LLP; Blake M. Bernard

(57) ABSTRACT

A drying apparatus is disclosed that includes at least a first absorbent layer and a waterproof layer attached to the first absorbent layer to form a drying body. At least three elongated handles can extend from radially from the drying body. Wet items such as food can be placed on the drying body and the elongated handles can be brought together to wrap the drying apparatus around the items. The elongated handles can be grasped by a user's hand and the drying apparatus can be swirled or slung by the elongated handles to force water and moisture from the items and into the absorbent layer of the drying apparatus to dry the items.

19 Claims, 4 Drawing Sheets

(56) References Cited

U.S. PATENT DOCUMENTS

| | | | | |
|---|---|---|---|---|
| 6,174,297 | B1 * | 1/2001 | Chen | A47K 7/02 15/209.1 |
| 6,200,027 | B1 | 3/2001 | Jones | |
| 6,229,132 | B1 * | 5/2001 | Knetter | A63B 47/005 219/759 |
| 6,385,817 | B1 * | 5/2002 | Johnson | A45C 13/002 15/208 |
| 6,718,590 | B1 * | 4/2004 | Jimison | A47J 43/28 15/209.1 |
| 7,328,523 | B2 * | 2/2008 | Vossoughi | A47L 13/18 34/90 |
| 7,601,655 | B2 * | 10/2009 | Katsin | B32B 5/26 442/192 |
| 8,679,600 | B2 * | 3/2014 | Vogle | A47J 43/24 383/116 |
| 10,113,264 | B2 * | 10/2018 | Hollis | D06F 59/04 |
| 10,641,550 | B2 * | 5/2020 | Reed | F26B 5/00 |
| 2003/0196348 | A1 * | 10/2003 | Hagemann | D06F 58/203 34/597 |
| 2005/0069672 | A1 | 3/2005 | Katsin | |
| 2005/0076530 | A1 * | 4/2005 | Kresser | F26B 25/18 34/91 |
| 2006/0236949 | A1 * | 10/2006 | Hill | A01K 1/0107 119/166 |
| 2009/0106873 | A1 | 4/2009 | Whiteside | |
| 2011/0131743 | A1 | 6/2011 | Hale | |
| 2014/0338210 | A1 * | 11/2014 | Young | B32B 5/26 34/95 |
| 2015/0342792 | A1 | 12/2015 | de la Torre Paniagua | |
| 2017/0055786 | A1 | 3/2017 | Tyszka | |

FOREIGN PATENT DOCUMENTS

| | | | | | |
|---|---|---|---|---|---|
| DK | 200800243 | U4 | | 12/2008 | |
| EP | 1686067 | A1 | | 2/2006 | |
| GB | 709196 | A | * | 5/1954 | B31B 70/00 |
| GB | 1070321 | A | * | 6/1967 | A47L 19/00 |
| JP | 09299679 | A | * | 11/1997 | |
| JP | 3171363 | U | | 10/2011 | |
| JP | 2014204937 | A | | 10/2014 | |
| JP | 6644382 | B2 | * | 2/2020 | |
| WO | WO-2020015866 | A1 | * | 1/2020 | F26B 9/003 |

* cited by examiner

DRYING APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. Patent Application No. 62/635,055 filed Feb. 26, 2018 entitled FOOD DRYING APPARATUS, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to drying apparatus for drying items having moisture or water on them. Particularly, food items such as fruits and vegetables are often washed in preparation for consumption or maintained in a humid environment to keep the fruits and vegetables fresh, however, the washing process or the humid environment can leave the fruits and vegetables damp. Additional clothes such as bathing suits can be taken off in a wet or dampened condition where it would be beneficial to be able to remove some of the moisture from such clothing items quickly.

Traditionally, in food preparation, when an article of food has excessive moisture on the surface of the food, a person would manually dry the food by patting a cloth on the wet surface of the food to remove the food. The manual contact of the surface of the cloth to the surface of the damp surface of the food would transfer the moisture to the cloth. This process can be especially burdensome in certain applications such as salad preparation or for drying herbs where there are many pieces of food and each piece has a large surface area. The process of drying each leaf of lettuce manually can be tedious and time consuming using this method.

Conventional solutions for drying food items such as fruits and vegetables can include salad spinners and the like. Most implementations are large, bulky, require large amounts of storage space, and include fragile parts which are difficult to fix or replace. Other solutions require time for the moisture to naturally fall off of the food, which is ineffective for time sensitive food preparation. Other systems include a drainage device such as net, basket, or mesh which water can pass through and be captured by an outer container. Such conventional solutions can require a certain amount of skill or finesse in removing the moisture from the food and not reintroducing the moisture back onto the food. Other systems include only a carrier made of a net or mesh material that can hold items to be washed under a sink and allow water to pass through the carrier, but such solutions allow residual water to drip or splatter from the net or mesh carrier once removed from the sink.

What is needed then is a system and/or method for effectively removing moisture from items such as food without the difficulties and inefficiencies seen in other implementations.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a drying apparatus that includes at least a first absorbent layer and a waterproof layer attached to the first absorbent layer to form a drying body. At least three elongated handles can extend radially from the drying body. Wet items such as food can be placed on the drying body and the elongated handles can be brought, folded, gathered, or converged together to wrap the drying apparatus around the items. The elongated handles can be grasped by a user's hand and the drying apparatus can be swirled or slung by the elongated handles to force water and moisture from the items and into the absorbent layer of the drying apparatus to dry the items.

Another aspect of the present disclosure is a drying apparatus including a first absorbent layer, a second absorbent layer, and a waterproof layer positioned between the first and second absorbent layers to form a reversible drying body, the reversible drying body having at least three corners. At least three elongated handles extending radially from a corresponding corner of the drying body. The drying body having two absorbent layers oriented opposite one another can allow both sides of the drying apparatus to be used to dry items.

Another aspect of the present disclosure is a method of removing water from an item, the method including the steps of providing a drying apparatus including a first absorbent layer and a waterproof layer attached to the absorbent layer to form a drying body, at least three elongated handles extending radially from the drying body; placing the item adjacent the first absorbent layer of the drying apparatus; bringing the at least three elongated handles together to at least partially surround the item with the first absorbent layer; and swirling the drying apparatus in a circular motion via the at least three elongated handles.

One objective of the disclosure is to provide an apparatus for drying items that have excessive moisture contained in or resting on the surface of the item.

Another objective of the disclosure is to provide a method for drying items having excess moisture contained within or on the item's surface by using a drying apparatus.

Numerous other objects, advantages and features of the present disclosure will be readily apparent to those of skill in the art upon a review of the following drawings and description of a preferred embodiment.

DETAILED DESCRIPTION

Figure 1:
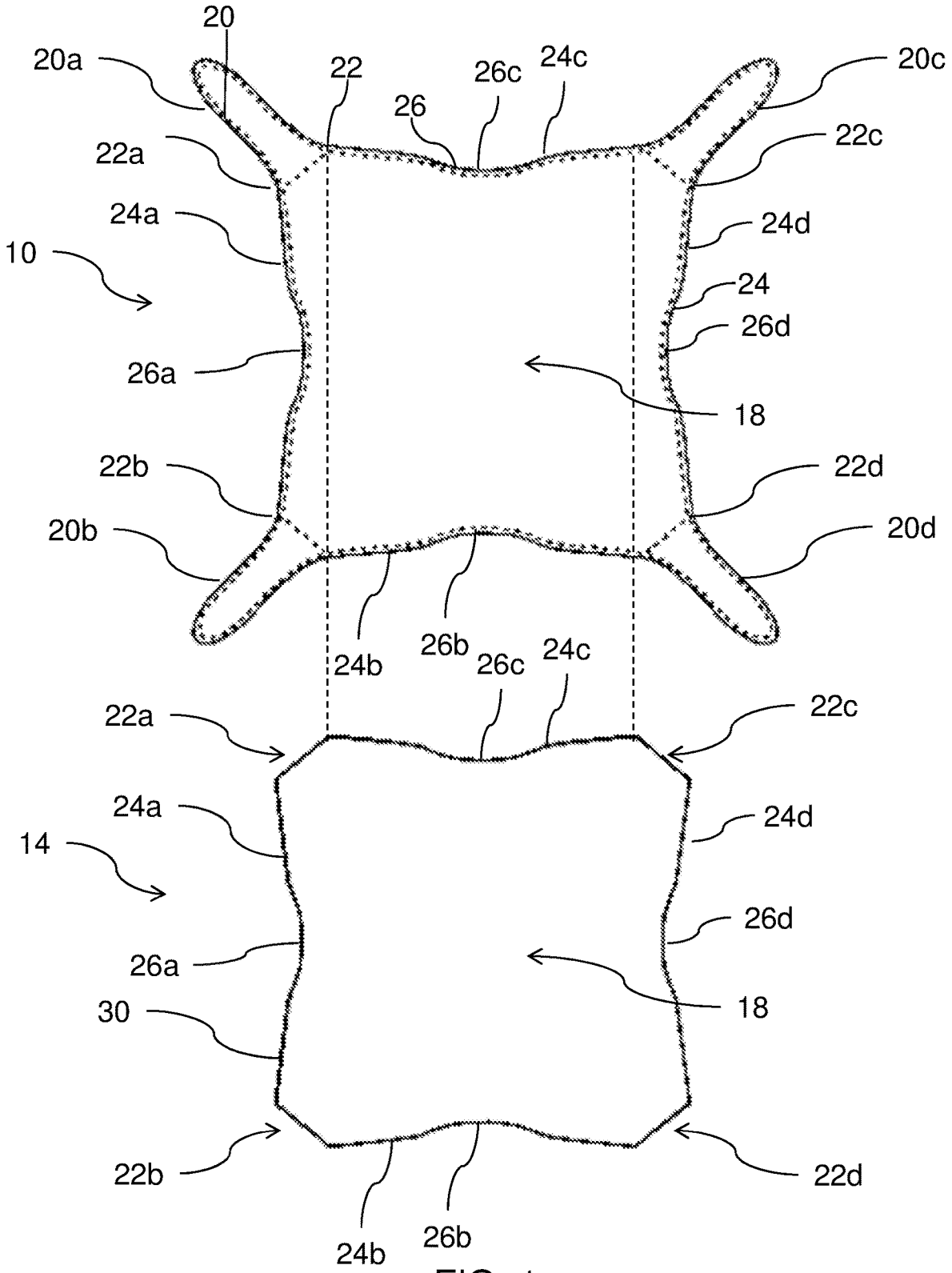
FIG. 1 is an exploded view of one embodiment of a drying apparatus of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

As seen in FIG. 1, a drying apparatus 10 is provided. The drying apparatus can be used to dry various items, including but not limited to foods such as fruits and vegetables, as well as other wet items such as clothing. The apparatus 10 can be utilized to dry any suitable item via centrifugal motion of the item. The drying apparatus 10 can include a first absorbent layer 12 and a waterproof layer 14 attached together for forming a drying body 18, and elongated handles 20*a*, 20*b*, 20*c*, and 20*d* extending from the drying body 18. The handles 20*a*, 20*b*, 20*c*, and 20*d* extend radially, or from a center of the drying body, in some embodiments. The drying apparatus 10 may be used to hold a damp or wet item, such as an article of food, the food positioned adjacent to and contacting the absorbent layer 12. The handles 20*a*, 20*b*, 20*c*, and 20*d* can be folded, converged, or gathered together by a user such that the drying apparatus 10 at least partially surrounds the item and forms a pouch 50 or sling in which the food sits. A user may then spin or swirl the drying apparatus 10 in circles while grasping the elongated handles 20*a*, 20*b*, 20*c*, and 20*d*. A centrifugal force results from the spinning motion and acts on the items positioned within the pouch 50 of the drying apparatus 10. The centrifugal force causes the moisture on the food to move outward from the food and to contact the absorbent layer 12. The water is absorbed into the absorbent layer 12 and the food remains dry after the user stops spinning the apparatus 10.

In some embodiments, the drying body 18 is not reversible and is comprised of a single absorbent layer 12 with a waterproof backing or layer 14, such that the drying body 18 is not reversible. In other embodiments, the drying apparatus 10 can include a first absorbent layer 12, a second absorbent layer 16, and a waterproof layer 14 positioned between the first absorbent layer 12 and the second absorbent layer 16. The waterproof layer 14 can be positioned between the first absorbent layer 12 and the second absorbent layer 16 to minimize or prevent contact between and water or moisture transfer between the first absorbent layer 12 and the second absorbent layer 16. The waterproof layer 14 can also prevent water from passing through the drying body 18 and being flung during spinning or swirling of the drying apparatus 10. The first absorbent layer 12, the second absorbent layer 16, and the waterproof layer 14 form a reversible drying body 18, with an absorbent layer 12 and 16 positioned on either side of the waterproof layer 14. Thus, when a user is using the drying apparatus 10, a user may place an item in contact with the first absorbent layer 12 and spin the drying apparatus 10 to remove the moisture from the item. If the food remains damp and the first absorbent layer 12 is saturated or nearly saturated with moisture, or if a second item needs to be dried, a user may place the item or second item in contact with the second absorbent layer 16 of the drying body 18 and spin the drying apparatus 10 to remove the moisture from the item or second item.

In some embodiments, the waterproof layer 14 has the same or substantially the same outer profile 30 and outer dimensions as the first absorbent layer 12 and the second absorbent layer 16. In other embodiments, the waterproof layer 14 can have a unique outer profile 30 and outer dimension relative to the first and second absorbent layers 12 and 16, a non-limiting example of which may be seen in FIG. 3. In some embodiments, the elongated handles 20*a*, 20*b*, 20*c*, and 20*d* may be integrally formed on the first and second absorbing layers 12 and 16. In such embodiments, the waterproof layer 14 may have an outer profile 30 and outer dimension which corresponds to the area of the first absorbent layer 12 and the second absorbent layer 16 which constitute the drying body 18 that surrounds the item and forms the pouch 50 when the handles 20*a*, 20*b*, 20*c*, and 20*d* are converged or gathered together.

Figure 2:
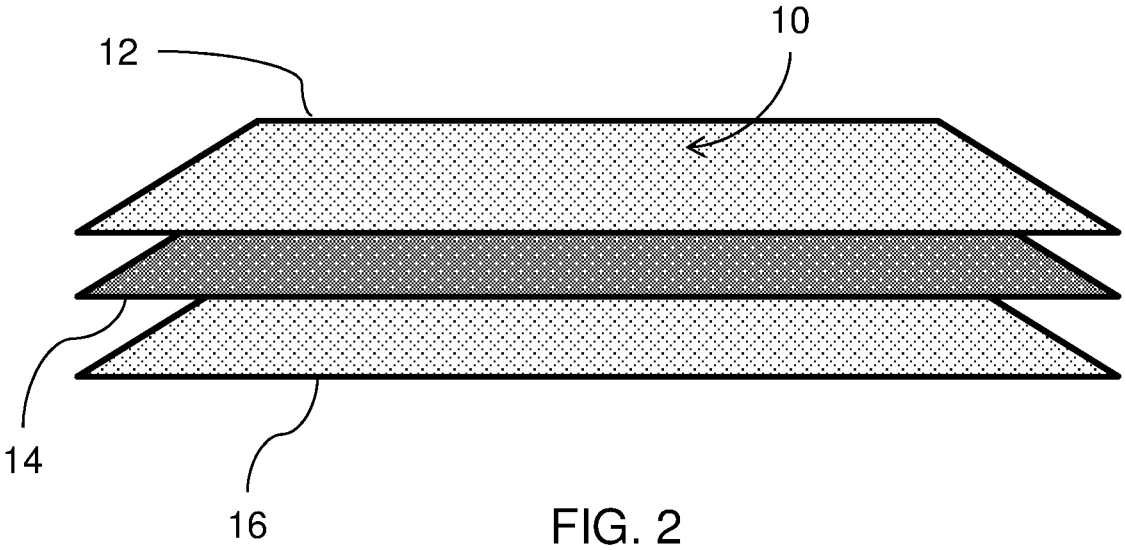
FIG. 2 is an exploded view of first and second absorbent layers and a waterproof layer of a drying apparatus of the present disclosure.
Figure 3:
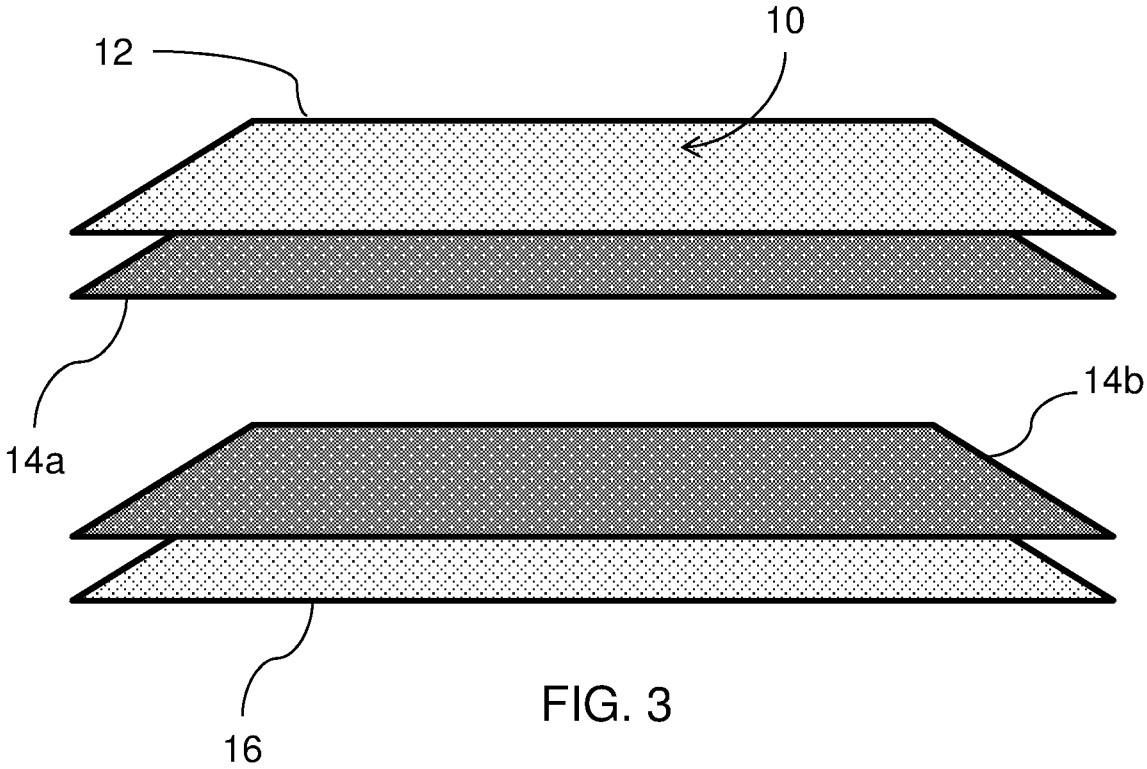
FIG. 3 is an exploded view of another embodiment of a drying apparatus having multiple absorbent layers each with a waterproof backing.

The first and second absorbent layers 12 and 16 can be attached to opposing sides of the waterproof layer 14, such that the waterproof layer 14 is sandwiched between the first and second absorbent layers 12 and 16, as shown in FIG. 2. Referring to FIG. 3, in some embodiments, the first absorbent layer 12 can have a first waterproof backing 14*a* and the second absorbent layer 16 can have a second waterproof backing 14*b*. For instance, some absorbent materials can be sold with a waterproof backing preformed on the absorbent layer. In such embodiments, the two waterproof backings 14*a* and 14*b* can be positioned facing or contacting each other with the first absorbent layer 12 is positioned outward from the waterproof backings 14*a* and 14*b* and the second absorbent layer 16 is positioned outward from the waterproof backings 14 *a* and 14*b* in a direction opposite from the first absorbent layer 12 such that the waterproof backings 14*a* and 14*b* are positioned or sandwiched between the first absorbent layer 12 and the second absorbent layer 16 to form a reversible drying body 18. In other embodiments, the drying apparatus 10 may comprise a first absorbent layer 12 having a waterproof backing 14*a* and a second absorbent layer 16 positioned adjacent to and attached directly to the waterproof backing 14*a* of the first absorbent layer 12. Subsequent layers of the apparatus 10 can be attached to one another via any suitable means, including but limited to, adhesives, stitching, friction welding, etc.

Referring again to FIG. 1, the drying apparatus 10 can include elongated handles 20*a*, 20*b*, 20*c*, and 20*d* extending from the drying body 18. The drying body 18 may be shaped such that the drying body 18 includes corners 22. For instance, in some embodiments, the drying body 18 can form a generally rectangular or quadrilateral shape with four corners. Corners 22 on the drying body 18 can come to sharp apex or include a corner edge or area from which handles 20*a*, 20*b*, 20*c*, and 20*d* can extend. An elongated handle 20 may extend from each of the corners 22 of the reversible drying body 18. Each handle 20*a*, 20*b*, 20*c*, and 20*d* may extend from a corresponding corner 22 (for example handle 20*a* on corner 22*a*, handle 20*b* on corner 22*b*, and so forth). In one embodiment, the drying body 18 may include four corners 22*a*-22*d*. Each handle 20*a*, 20*b*, 20*c*, and 20*d* extends from a corresponding corner 22 of the four corners 22*a*-22*d*.

In other alternate embodiments, the reversible drying body 18 can include at least three corners 22 and the apparatus 10 can include at least three corresponding handles 20*a*, 20*b*, 20*c*, and 20*d*, for instance for a triangular shaped drying body 18, or the drying body 18 can include at least five corners 22 and the apparatus 10 can include at least five corresponding handles in other embodiments. In other embodiments, the apparatus can include up to 8 elongated handles extending radially from the drying body 18.

In some embodiments, the drying body 18 can have a generally circular shape without any corners, and the handles 20 can extend radially about the circular drying body 18. In some embodiments, the handles 20 can extend radially and symmetrically from the drying body 18.

Each handle 20 may be integrally formed on the drying body 18 and extend from the corners 22 of the drying body 18, for instance into the absorbent layers 12 and 16 at each corresponding corner 22, or the handles 20 may be attached to the drying body 18. In some embodiments, the handles 20 may be attached to the drying body 18 via a stitched or sewn connection, forming a seam.

The handles 20 can be elongated and shaped such that a user may easily grasp each of the handles 20 with a firm grip. Each handle 20 can be shaped relatively thin such that when the handles 20 are converged or brought together the handles 20 can be grasped in a single hand such that the user can have a firm, full-handed grip on each of the handles 20. The handles 20 may be elongated to provide an adequate section or surface of material for gripping the handle 20. Elongated handles 20 in some embodiments can extend radially outward from the drying body 18, and particularly from each corner 22 of the drying body 18.

In some embodiments, each of the elongated handles 20 can have a length 32, and the drying body 18 can have a width 30 and a diagonal dimension 34. In some embodiments, the ratio of the width 30 of the drying body 18 to the length of the elongated handles 20 can be less than about 4. In some embodiments, the ratio of the width 30 of the drying body 18 to the length of the elongated handles 20 can be less than about 3. In still other embodiments, the ratio of the width 30 of the drying body 18 to the length of the elongated handles 20 can be less than about 2. In some embodiments, the ratio of the diagonal dimension 34 of the drying body 18 to the length of the elongated handles 20 can be less than about 5. In some embodiments, the ratio of the diagonal dimension 34 of the drying body 18 to the length of the elongated handles 20 can be less than about 4. In still other embodiments, the ratio of the diagonal dimension 34 of the drying body 18 to the length of the elongated handles 20 can be less than about 3. Longer handles 20 relative to the dimensions of the drying body can provide a longer distance between a user's hand and items placed in the drying apparatus 10 during swirling or slinging of the food drying apparatus. A great moment arm can provide a greater centrifugal force on the items during swirling to help increase the amount of water extracted from the items.

The drying body 18 of the drying apparatus 10 can further comprise outer edges 24 extending or positioned between adjacent elongated handles 20 or pairs of handles 20 and corners 22 (for example, between corner 22*a* and corner 22*b*, and between corner 22*b* and corner 22*d*). The outer edges 24 extending between corresponding adjacent corners 22 of the reversible drying body 18 can form an outer profile or an outer dimension of the drying body 18. In some embodiments, the outer edges 24 of the drying body 18 extending between adjacent corners 22 can be substantially linear. Each of the outer edges 24 can have a midline. In some embodiments, the outer edge may have an indentation or notch 26 extending inward or towards the center of the drying body 18, wherein each indentation or notch 26 can be positioned at the midline of a corresponding outer edge 24.

The notches 26 can help reduce holes or openings in the pouch 50 formed from excess material when the handles 20*a*, 20*b*, 20*c*, and 20*d* are brought, gathered or converged together. When a substantially square reversible drying body 18 with elongated handles 20*a*, 20*b*, 20*c*, and 20*d* extending from the corners 22 is folded at positioned to form a pouch 50 after the handles 20 are gathered together, large folds or creases can form at the midline of each of the outer edge 24 of the reversible drying body 18 extending between each handle 20*a*, 20*b*, 20*c*, and 20*d*, the creases or folds forming holes where items can potentially fall out of the pouch 50 during swirling or spinning of the apparatus 10. The notches 26 formed at the midline of each outer edge 24 of the reversible drying body 18 minimize the folding and creasing that occurs at midline. The notches 18 can help provide a more secure and enclosed pouch 50 for containing the food during the drying process. Furthermore, the notches 26 can provide a reduction in weight from the reversible drying body 18.

Figure 4:
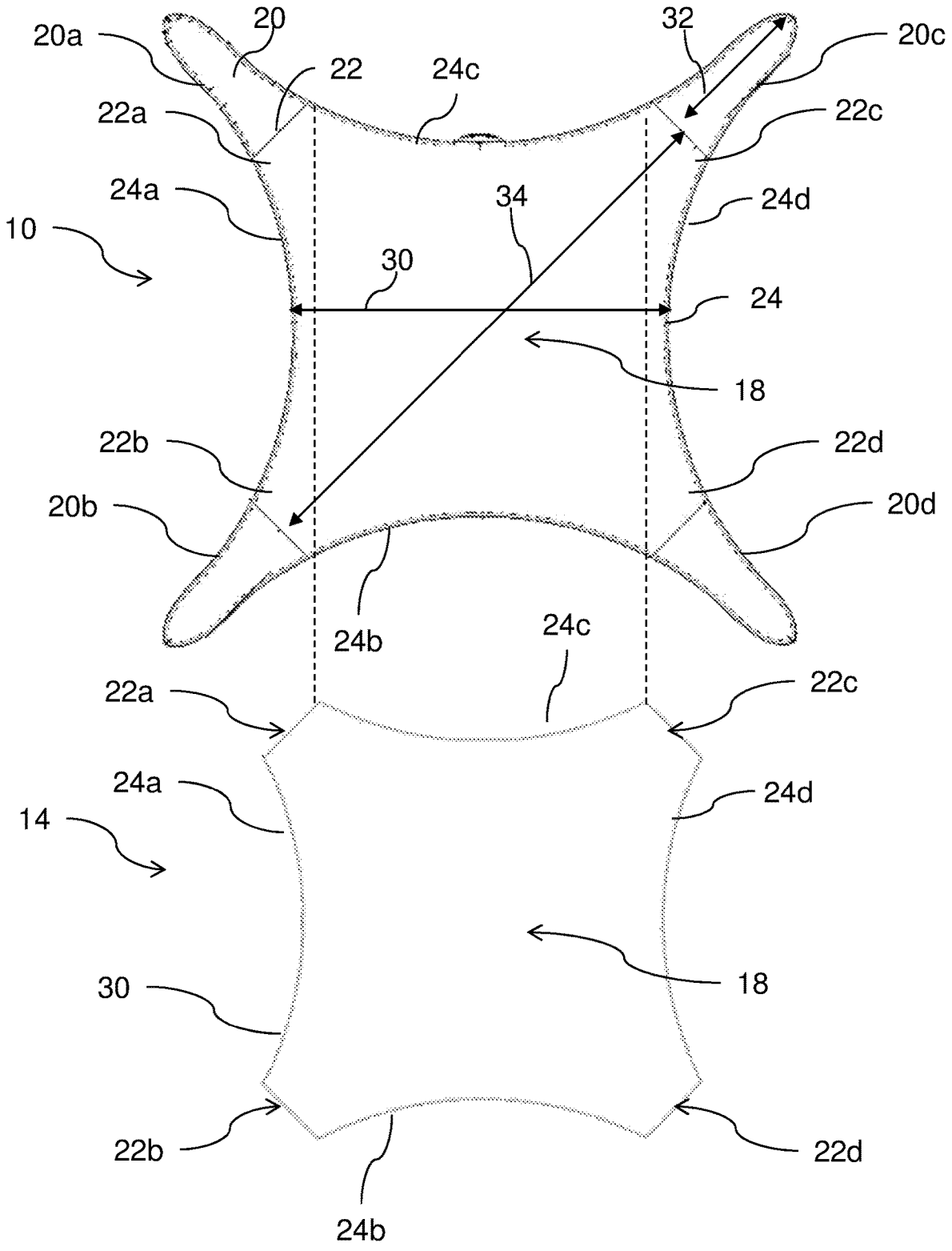
FIG. 4 is an exploded view of another embodiment of a drying apparatus with a drying body having inwardly concave outer edges between elongated handles.

In other embodiments, as shown in FIG. 4, the outer edges 24 can have a generally inwardly concave shape as the outer edges 24 extend between corresponding pairs of handles 20 and corners 22. Outer edges 24 having an inwardly concave shape can help provide a similar benefit as the notches 26 in FIG. 1 as the concave outer edges 24 can help reduce creases or folds along the outer edges 24 as the handles 20 are brought, gathered, or converged together to help retain items in the pouch 50 during swirling or spinning of the apparatus 10.

Figure 5:
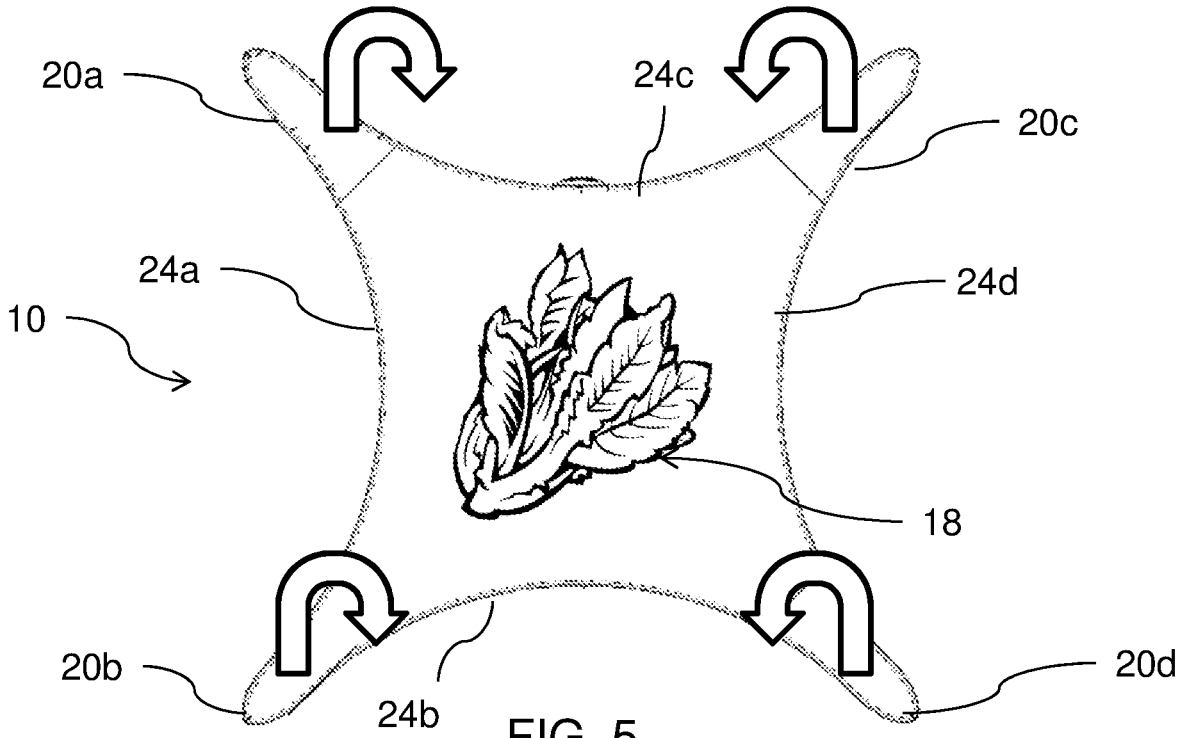
FIG. 5 shows an item placed on the drying apparatus of FIG. 4.
Figure 6:
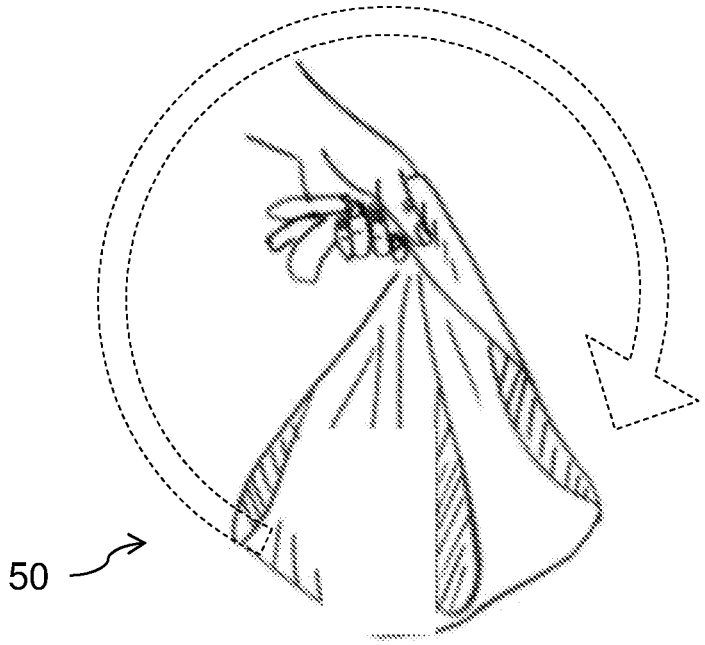
FIG. 6 shows the handles of the drying apparatus of FIG. 4 converged and the drying apparatus surrounding the item, the drying apparatus configured to be swirled in a circular motion to dry the item.

A method for drying food using a drying apparatus 10 is provided, portions of which are depicted in FIG. 5 and FIG. 6. The method includes providing a drying apparatus 10 including a first absorbent layer 12, a waterproof layer 14 attached to the absorbent layer 12 to form a drying body 18, and at least three elongated handles 20 extending radially from the drying body 18. The drying apparatus 10 can further include any of the various features discussed herein. The method further includes placing an item on a drying body 18 adjacent the first absorbent layer 12 of the apparatus 10. The handles 20 can be brought, gathered, or converged together to at least partially surround the item with the first absorbent layer 12. The drying apparatus 10 can then be swirled via the handles 20 in a circular motion to dry the item held within the drying apparatus 10.

As the elongated handles 20*a*, 20*b*, 20*c*, and 20*d* are gathered, a pouch 50 is formed around the item placed on the drying body 18. The user then grasps each of the elongated handles 20*a*, 20*b*, 20*c*, and 20*d* in one hand. The user then swings, swirls, or slings the drying apparatus 10 in circles via the handles 20 such that the pouch 50 containing the item revolves around the user's hand via the elongated handles 20*a*, 20*b*, 20*c*, and 20*d*. Stated otherwise, a centrifugal force may be applied to the item and water on the item placed in the pouch 50 formed by the drying body 18 by rotating the drying apparatus 10 about a rotational axis extending through the user's hand or a distal end of the handles 20*a*, 20*b*, 20*c*, and 20*d*, wherein the pouch 50 revolves around the rotational axis.

As the pouch 50 is revolving around the handles 20*a*, 20*b*, 20*c*, and 20*d*, the water or moisture is acted upon by the centrifugal force and migrates radially outward from the axis of rotation of the drying apparatus 10. The moisture contacts the absorbent layer 12, 16 of the reversible drying body 18 and is absorbed. The moisture is not able to migrate radially outward beyond the waterproof layer 18 as the waterproof layer 18 provides a centripetal force in a direction opposite the centrifugal force applied to the moisture and the waterproof layer 14 contains no pores through which the moisture may pass. Once the user has determined that an appropriate amount of spinning has occurred for the moisture to be removed from the surface of the food, the user may terminate the spinning of the drying apparatus 10. The drying apparatus 10 may then by placed on a surface such as a table. The drying apparatus 10 is capable of lying flat on or flush with the surface when each of the elongated handles 20*a*, 20*b*, 20*c*, and 20*d* is pulled radially outward relative to a central point of the drying apparatus 10.

In some embodiments, the drying apparatus 10 can further include a second absorbent layer 16, the waterproof layer 14 positioned between the first and second absorbent layers 12 and 16. The method can further include turning the drying apparatus 10 over, placing the item adjacent the second absorbent layer 16 of the drying apparatus 10, bringing the at least three elongated handles 20 together to at least partially surround the item with the second absorbent layer 16, and swirling the drying apparatus 10 in a circular motion via the at least three elongated handles 20. In some embodiments, a second item can be dried by the drying apparatus 10. The method can further include removing the first item from the drying apparatus 10, turning the apparatus 10 over, placing a second item adjacent the second absorbent layer 16 of the drying apparatus 10, bringing the at least three elongated handles 20 together to at least partially surround the second item with the second absorbent layer 18; and swirling the drying apparatus 10 in a circular motion via the at least three elongated handles 20.

A user may fold and store the drying apparatus 10 in small places suitable for other household or workplace items, such as in a linen closet, a drawer, or a cabinet. The absorbent layers 12, 16 may include a number of various materials including highly absorbent and/or quick dry materials. For example, the absorbent layer 12, 16 may be made of material including but not limited to cotton, microfibers, bamboo linen blends, hemp blends, fleece, wool, foams, rayon, polyesters, etc. The absorbent layer 12, 16 may also include certain manufacturing patterns to help improve absorbency such as terry loops and bird's eye patterns. The waterproof layer 14 may include a variety of materials including, but not limited to, polyurethane, synthetic fleece, vinyl, polytetrafluoroethylene, rubber, polyvinyl chloride, silicone elastomer, fluoropolymers, and waxes. In some embodiments, the waterproof layer 14 can include non-waterproof material coated with a waterproof material or substance. For instance, in one embodiment, the waterproof layer 14 can include a polyurethane coated fabric. However, any suitable material known to one of skill in the art for waterproofing or absorption may be used.

Thus, although there have been described particular embodiments of the present invention of a new and useful DRYING APPARATUS, it is not intended that such references be construed as limitations upon the scope of this invention.

What is claimed is:

1. A drying apparatus, comprising:
a first absorbent layer;
a waterproof layer attached to the first absorbent layer to form a drying body; and
at least three elongated handles extending radially from the drying body.

2. The apparatus of claim 1, further comprising a second absorbent layer attached to the waterproof layer, the waterproof layer positioned between the first absorbent layer and the second absorbent layer, wherein the drying body is reversible.

3. The apparatus of claim 2, wherein the at least three elongated handles are integrally formed on the first and second absorbent layers.

4. The apparatus of claim 1, wherein the drying body further comprises outer edges extending between adjacent elongated handles, wherein each of the outer edges has a midline.

5. The apparatus of claim 4, wherein the drying body further comprises corresponding indentions defined in each of the outer edges at the midline of each of the outer edges.

6. The apparatus of claim 1, wherein the drying body includes at least three corners, and the at least three elongated handles each extend from a corresponding corner of the drying body.

7. The apparatus of claim 1, wherein the at least three elongated handles extend radially and symmetrically about the drying body.

8. The apparatus of claim 1, wherein:
the drying body further comprises corresponding outer edges positioned between adjacent pairs of elongated handles; and
the outer edges have an inwardly concave shape.

9. The apparatus of claim 1, wherein:
the drying body has a width; and
each of the elongated handles has a length, a ratio of the drying body width to the length of the elongated handles is less than 3.

10. The apparatus of claim 1, wherein:
the drying body has a diagonal dimension measured as a distance between opposing corners of the drying body;
each of the elongated handles has a length; and
a ratio of the diagonal dimension of the drying body to the length of the elongated handles is less than 4.

11. A drying apparatus comprising:
a first absorbent layer;
a second absorbent layer;
a waterproof layer positioned between the first and second absorbent layers to form a reversible drying body, the reversible drying body having at least three corners; and
at least three elongated handles extending radially from a corresponding corner of the drying body.

12. The drying apparatus of claim 11, wherein:
the first absorbent layer has a first waterproof backing; and
the second absorbent layer has a second waterproof backing, the first waterproof backing and the second waterproof backing attached to one another to form the waterproof layer of the reversible drying body.

13. The drying apparatus of claim 11, wherein the waterproof layer further comprises a fabric material coated with a polyurethane laminate.

14. The drying apparatus of claim 11, wherein the first and second absorbent layers further comprise a microfiber terry loop fabric.

15. A method of removing water from an item, the method comprising the steps of:

providing a drying apparatus including a first absorbent layer and a waterproof layer attached to the absorbent layer to form a drying body;

at least three elongated handles extending radially from the drying body;

placing the item adjacent the first absorbent layer of the drying apparatus;

bringing the at least three elongated handles together to at least partially surround the item with the first absorbent layer; and swirling the drying apparatus in a circular motion via the at least three elongated handles.

16. The method of claim 15, wherein the drying apparatus further comprises a second absorbent layer, the waterproof layer positioned between the first and second absorbent layers; and the method further comprises:

placing the item adjacent the second absorbent layer of the drying apparatus;

bringing the at least three elongated handles together to at least partially surround the item with the second absorbent layer; and swirling the drying apparatus in a circular motion via the at least three elongated handles.

17. The method of claim 15, wherein the waterproof layer prevents water from the items from passing through the waterproof layer during the swirling step.

18. The method of claim 17, wherein the water is absorbed by the absorbent layer during the swirling step.

19. The method of claim 15, wherein the drying apparatus further comprises a second absorbent layer, the waterproof layer positioned between the first and second absorbent layers, and the method further comprises the steps of:

removing the item from the drying apparatus;

placing a second item adjacent the second absorbent layer of the drying apparatus;

bringing the at least three elongated handles together to at least partially surround the second item with the second absorbent layer; and swirling the drying apparatus in a circular motion via the at least three elongated handles.

* * * * *